United States Patent [19]

Guillon et al.

[11] Patent Number: 4,468,913

[45] Date of Patent: Sep. 4, 1984

[54] METHOD OF CONDITIONING AND A BOX FOR THE IMPLEMENTATION THEREOF

[75] Inventors: Claude R. Guillon, Courbevoie; Annick Schwarz, Feucherolles, both of France

[73] Assignee: Sofrigam, Courbevoie, France

[21] Appl. No.: 336,366

[22] PCT Filed: May 5, 1981

[86] PCT No.: PCT/FR81/00061

§ 371 Date: Dec. 23, 1981

§ 102(e) Date: Dec. 23, 1981

[87] PCT Pub. No.: WO81/03162

PCT Pub. Date: Nov. 12, 1981

[30] Foreign Application Priority Data

May 7, 1980 [FR] France ..... 80 10197

[51] Int. Cl.[3] ..... B65B 63/08

[52] U.S. Cl. ..... 53/440; 53/472; 53/127; 206/542; 206/545

[58] Field of Search ..... 53/440, 127, 472, 474, 53/467; 206/223, 542, 545

[56] References Cited

U.S. PATENT DOCUMENTS 2,302,639 11/1942 Moore ..... 53/472 X
2,393,245 1/1946 Hadsell .
2,897,641 8/1959 Simon et al. ..... 53/472 X
3,182,884 5/1965 Waldron .
3,204,385 9/1965 De Remer et al. ..... 53/472 X
3,733,768 5/1973 Carls et al. ..... 53/440 X

FOREIGN PATENT DOCUMENTS 463158 2/1946 Belgium .
1124663 10/1956 France .

*Primary Examiner*—Horace M. Culver
*Attorney, Agent, or Firm*—Woodcock, Washburn, Kurtz, Mackiewicz & Norris

[57] ABSTRACT

Method and box for conditioning products which must be stored under determined temperature conditions, generally different from the conditions of the environment. The method consists in placing within an open, thermally insulated enclosure (1), some removable reserve elements (26 to 30), placing the products within the volume delimited by the reserve elements (26 to 30) inside the enclosure (1), removing the reserve elements (26 to 30), replacing them by heat or cold accumulating elements brought to the required predetermined temperature and having shapes and dimensions similar to those of the reserve elements (26 to 30), and closing the enclosure (1). Application to the conditioning of products sensitive to temperature, especially such as vaccines, serums, etc.

3 Claims, 12 Drawing Figures

METHOD OF CONDITIONING AND A BOX FOR THE IMPLEMENTATION THEREOF

This invention relates to a method of conditioning and to a box for the implementation thereof.

More precisely, the present invention relates to the conditioning of products which must be stored under determined temperature conditions, generally different from the conditions of the environment, for example for preservation reasons, as is the case for some fresh food products or vaccines which must be preserved at a temperature below a determined temperature threshold whatever the temperature conditions of the environment during their transport or storage outside cold rooms.

For transporting or storing such products which are liable to be damaged by a rise in temperature outside cold rooms, or for transporting or storing products which are liable to be damaged by a drop in temperature, it is known to position these products inside a thermally insulated enclosure and to surround them within this enclosure with respectively heat or cold accumulating elements (hereinafter referred to generically as "accumulating elements") which have previously been brought to a predetermined temperature required by the nature of the product, the thermal insulation characteristics of the enclosure, the ambient temperature conditions to which it will be submitted once outside and the desired preservation time.

Unfortunately, in the present prior art, if such a method of conditioning may be completely satisfactory when it is a matter of packing inside an enclosure a small number of objects which only necessitate the enclosure being kept open for a short time and offer the opportunity of rationally positioning respectively heat or cold accumulating elements, i.e., generally positioning these elements along the insulating walls of the enclosure in order to produce a respectively cold or hot barrier at this level, the same does not hold true when a large number of individualised products, for example, ampoules of vaccine have to be conditioned within the same enclosure.

In fact, in this case, the known conditioning technique comprises arbitrarily distributing cold accumulating elements (in the case of vaccines or serums), which have been brought to the required temperature between the products as they are positioned inside the enclosure which is kept open.

On the one hand, the fact that the conditioning of such products requires keeping the enclosure open for a considerable length of time means that the cold accumulating elements which are positioned as conditioning proceeds lose some of their coldness before the enclosure is closed, which renders them inefficient and means that they have to be overdimensioned or increased in number, without for all that the guarantee of complete efficiency, notably concerning the first elements positioned inside the enclosure.

On the other hand, the random distribution of the cold accumulating elements in the midst of the conditioned products gives rise to temperature heterogeneities inside the enclosure, and gives rise notably to relatively hot points where the temperature may exceed the maximum temperature threshold which the product to be conditioned cannot exceed without being damaged. Thus, prudence also requires the accumulating elements to be overdimensioned or for an excessive number thereof to be provided.

Of course, the same disadvantages are established when such products are conditioned by this conventional method, the temperature of which products must not fall below a determined threshold, in the presence of heat accumulating elements.

In one or other case, the accumulating elements have to be overdimensioned or increased in number, i.e., the useful capacity of the enclosure has to be reduced, and this means reducing the quantity of conditioned product within an enclosure of determined internal dimensions.

In the particular case of conditioning serum or vaccine ampoules in the presence of cold accumulating elements distributed between these ampoules, a further disadvantage is established in that there is a risk of the cold accumulating elements being perforated, these elements generally being produced in the form of bags containing a cold accumulating liquid, which then spills over the product and soils it.

The object of the present invention is to overcome these disadvantages while providing the possibility of positioning heat or cold accumulating elements inside the enclosure after having positioned therein the products to be conditioned, with a possibility of an optimum distribution of the accumulating elements, allowing them to be used in the best manner possible and consequently, to reduce the number and over-all dimensions thereof to a necessary minimum.

For this purpose, the conditioning method according to the present invention, for products which have to be stored under determined temperature conditions, generally different from the conditions of the environment, comprising positioning within an open, thermally insulated conditioning enclosure, products and heat or cold accumulating elements at a required predetermined temperature, then closing the enclosure, is characterised in that removable reserve elements are positioned inside the open enclosure, the products are positioned inside the volume delimited by the reserve elements in the enclosure, the reserve elements are removed, are replaced by heat or cold accumulating elements which are at the required predetermined temperature and have shapes and dimensions similar to those of these reserve elements, and the enclosure is closed.

According to a preferred embodiment of the method, only some of the reserve elements are removed and replaced by accumulating elements before the enclosure is closed and, after closing, the enclosure is re-opened in a different zone, opposite the remaining reserve elements, in order to remove and replace the latter before closing the enclosure. Thus, it is possible to cover at least a part, and even preferably all of the inside periphery of the open enclosure with reserve elements which are then removed and replaced by accumulating elements and if, according to a preferred embodiment, such accumulating elements are also positioned level with the opening of the enclosure after having positioned the product therein and before closing the enclosure, a thermal barrier is obtained, after closing, at the required predetermined temperature over all the inside periphery of the enclosure, which increases the insulating capacities thereof.

Of course, some reserve elements may also be distributed inside the enclosure in view of being subsequently replaced by accumulating elements after the product has been introduced, which allows the inside of the enclosure to be divided into compartments by means of accumulating elements which do not lose practically any heat or cold which has built up before the enclosure is closed.

This optimum distribution of the accumulating elements and the maximum use of the accumulation capacity thereof allows the amassed number and volume of the elements to be reduced and, consequently, provides a greater useful volume of the enclosure, if a comparison with the conventional technique is made.

Moreover, in the particular case of conditioning ampoules in the presence of cold accumulating elements, the possibility of a relatively strict positioning of these elements and the conditioned ampoules allows a judicious choice of this positioning and consequently, a minimisation of risks of perforation.

Other characteristics and advantages of the present invention will be revealed in the following description relating to an unrestricting embodiment, and from the accompanying drawings which are an integral part of this description.

Figure 1:
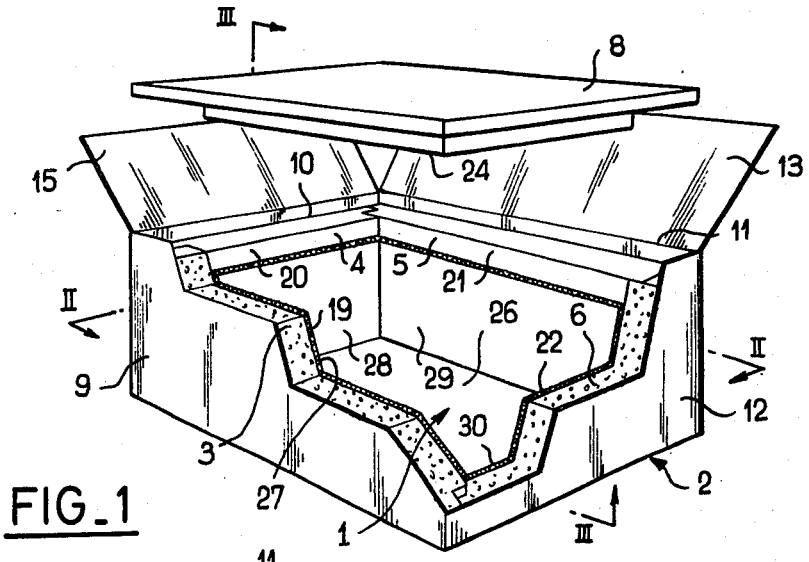
FIG. 1 illustrates a perspective view, with a partly torn-away area, of a box which is to be used in the method according to the present invention in an open position.

In its illustrated embodiment, the box is in the form of a parallelepiped rectangle both externally as well as internally, being particularly well adapted to the stacking and juxtaposition of boxes with minimum congestion, but it is of course possible to put the invention into operation using boxes of a different shape.

In order to thermally insulate from outside the enclosure 1 which the box delimits internally, said box has walls with thermal insulation properties. Thus, in the example illustrated, the box is defined by a cardboard envelope 2 which is integrally lined internally by sheets 3 to 8 of a material having thermal insulation properties, for example, a polyurethane foam in the form of sheets or moulded elements which, at their junction which is generally close to an edge of the box have a staggered mutual fitting form. The thickness of these sheets or insulating elements 3 to 8 is selected depending on the desired preservation residence time in the box of the products which are to be conditioned therein, on the ambient temperature at which this box is to be externally exposed, and on the nature of the products to be preserved in this box.

The cardboard envelope 2 is in a form, known in the field of cardboard packing boxes, of a circle defined by four rectangular walls 9 to 12, parallel and identical in pairs, which will be assumed to be orientated vertically and connected in pairs at a right angle, along vertical edges of the envelope 2. Each of these walls 9 to 11 supports flaps respectively along its upper horizontal edge and along its lower horizontal edge, which flaps, being turned under and superpositioned in a position which will be assumed to be horizontal, respectively form a lid and a base for the envelope 2. Thus, in the example illustrated, the two identical, parallel and vertical walls 9 and 11 support a rectangular flap along their upper edge which cannot be seen for reasons of clarity as far as the wall 9 is concerned, but being visible and designated by reference numeral 13 as far as wall 11 is concerned, and along their lower edge, a flap which is again invisible as far as wall 9 is concerned, and designated by reference numeral 14 as far as wall 11 is concerned. Likewise, the identical, vertical walls 10 and 12 support rectangular flaps, respectively 15 and 16, along their respective upper edge, and support a second flap, respectively 17 and 18 along their respective lower edge. It will be noted that this information of the upper and lower edge refers to the position illustrated in FIG. 1 and to FIGS. 3 to 7, FIGS. 8 to 12 illustrating the box in a position in which it has been turned over.

In a known manner, the envelope is fully closed when the flaps equipping the upper edges of the four walls 9 to 12 are turned down one over the other at a right angle with respect to the walls 9 to 12, to define the lid of the envelope, as well as the flaps equipping the lower edges of the walls 9 to 12 and which, turned under one over the other at 90° with respect to these walls define the base of the envelope.

When the box is closed, i.e., when the envelope 2 is closed and the thermal insulation lining elements 3 to 8 are in position, each of these elements 3 to 8 presents towards the inside of the box a flat surface, respectively 19 to 24, parallel to the wall of the envelope 2 which this element lines, i.e., respectively to the walls 9 to 12, to the base wall and to the lid wall, these surfaces joining to define the enclosure 1.

According to the present invention, during the production of the box or previously to the conditioning of a product inside the box, the upper flaps being in the open position and the element 8 having been removed, removable reserve elements are positioned inside the enclosure 1, the role of these elements being to provide inside the enclosure, during the filling thereof, volumes which are capable of later receiving, before the enclosure is closed, heat or cold accumulating elements brought to a predetermined temperature required by the preservation of the conditioned product.

These reserve elements may have various shapes and may be distributed in diverse manner inside the enclosure 1, provided that they may be removed and replaced by heat or cold accumulating elements after the at least partial, and preferably total filling of the enclosure 1 with the product to be conditioned.

Figure 2:
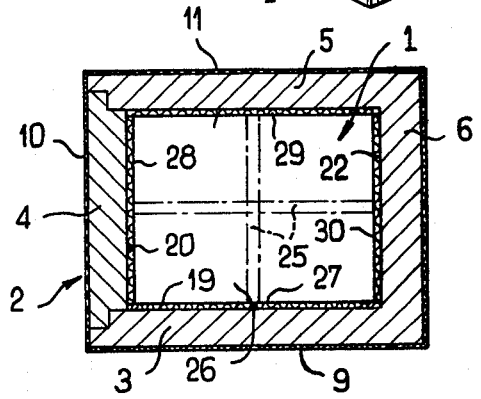
FIG. 2 illustrates a sectional view of this box through a horizontal plane, i.e., parallel to the base thereof, such as the plane II—II of FIG. 1.

Thus, for example, in an embodiment simplified in FIG. 2 by dash-dotted lines 25, these reserve elements may form an internal partitioning of the enclosure 1, and may be presented in the form of vertical panels 25 in the position of the box illustrated in FIG. 1, which may be extracted through the open lid of the box, after filling the volume which they delimit inside the enclosure 1 with product to be conditioned, in order to replace them by heat or cold accumulating elements.

However, according to a preferred embodiment illustrated in solid lines, and which may advantageously be combined with the previous embodiment, the reserve elements integrally cover the walls of the open box inside the enclosure 1.

Figure 3:
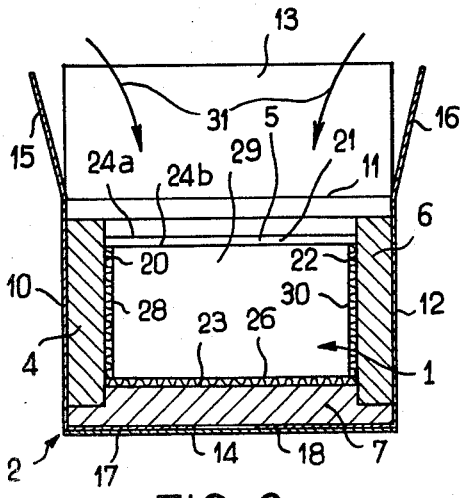
FIGS. 3 to 12 illustrate successive stages of the conditioning using the box illustrated in FIGS. 1 and 2, this box being in a sectional view through a vertical plane, such as the plane III—III of FIG. 1.

Thus, by referring to FIGS. 1 to 3, it may be seen that the surface 23 is integrally covered by a flat reserve element 26, the plan shape of which is rectangular and the plan dimensions of which are those of the surface 26 delimited inside the enclosure 1 by the surfaces 19 to 22 of the insulating elements 3 to 6. These surfaces 19 to 22 are also integrally or almost integrally covered by reserve elements in the form of rectangular panels, respectively 27 to 30, touching in pairs and in contact with the element 26.

The reserve elements 26, the only role of which is to provisionally reserve the necessary volume for the heat or cold accumulating elements during the filling operation of the enclosure 1 may be produced in various ways; for example, they may be thick sheets of cardboard, possibly in a multiple thickness, but other embodiments could naturally also be selected without thereby exceeding the scope of the present invention. These elements are advantageously produced from a material which is adequately resistant, so that they may be re-used.

Before the enclosure is filled, the box is in the shape illustrated in FIGS. 1 to 3, where the reserve panels 26 to 30 are in position against the corresponding surfaces and where, the upper flaps such as 13, 15 and 16 being in a position where they free the upper surface of the box, the element 8 is removed to allow access inside the enclosure 1. The base flaps such as 14, 17 and 18 then provisionally occupy their closed position, where they are superpositioned in a position at a right angle with respect to the lateral walls 9 to 12 of the envelope 2.

The volume delimited inside the enclosure 1 by the reserve elements 26 to 30 is filled as indicated by the arrows 31 of FIG. 3, up to a level at the most equivalent to the level 24*a* which is to be occupied by the surface 24 of element 8 when the box is closed, and preferably only up to a level 24*b* which is lower than this level 24*a* by a distance equal to the thickness of a heat or cold accumulating element 37 which will later be positioned above the product 32 in the enclosure before this is closed by the element 8, then by superpositioning the flaps such as 13, 15 and 16, as will be shown later on.

Figure 4:
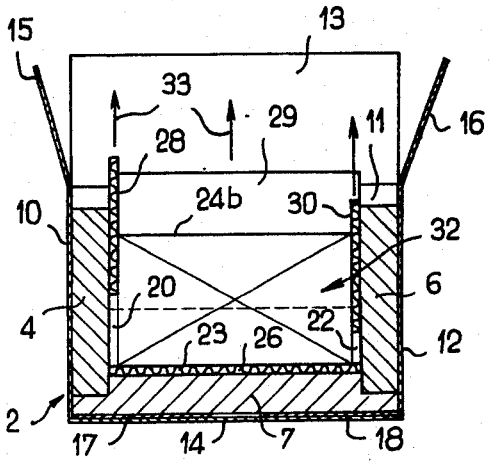

Then, as illustrated in FIG. 4, the box still being open at its upper part, but the product 32 being in its definite conditioning position, the reserve elements 27 to 30 are released by sliding them upwards, i.e., towards the outside of the box via the upper opening thereof, between the product 32 and the surfaces, respectively 19 to 22 of the insulating elements 3 to 6 turned towards the inside of the enclosure. This movement is simplified by arrows 33 in FIG. 4, where only the reserve elements 28 to 30 are shown.

Figure 5:
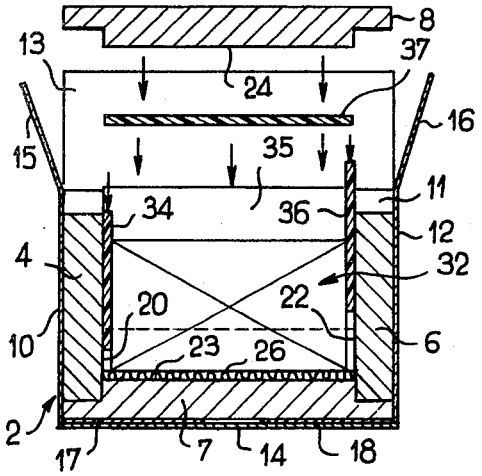

During the following stage of conditioning, illustrated in FIG. 5, into the space which is thus provided around the product 32 inside the enclosure 1 are introduced heat or cold accumulating elements, the shapes and dimensions of which are such that they integrally occupy the volume thus provided. Thus, the reserve element 28 is replaced by an accumulating element 34 having an identical shape and dimensions, the element 29 is replaced by an accumulating element 35 having a shape and dimensions which are identical to those of this element 29, the element 30 is replaced by an accumulating element 36 having a shape and dimensions similar to those of this element 30, and the element 27 is replaced by an accumulating element which cannot be seen in the Figures, but which has a shape and dimensions indentical to those of element 27. The accumulating elements have previously been brought to the required and predetermined temperature.

The product 32 and the respective upper edges of the accumulating elements 34 to 36 and of the accumulating element substituted for the reserve element 27 are covered by means of a similar accumulating element 37, which has also been previously brought to the required, predetermined temperature. Bearing in mind the difference between the levels 24*a* and 24*b*, the similarity in shape and dimensions between the accumulating elements and the reserve elements which the accumulating elements replace, and the filling with product 32 up to level 24*b* during the stage illustrated in FIG. 4, the element 37 is in contact with the accumulating elements 34 to 36 and with the analogous accumulating element substituted for the reserve element 27, at the level of the respective upper edges of these elements, and it integrally occupies the volume positioned inside the enclosure, between the levels 24*b* and 24*a*.

Figure 6:
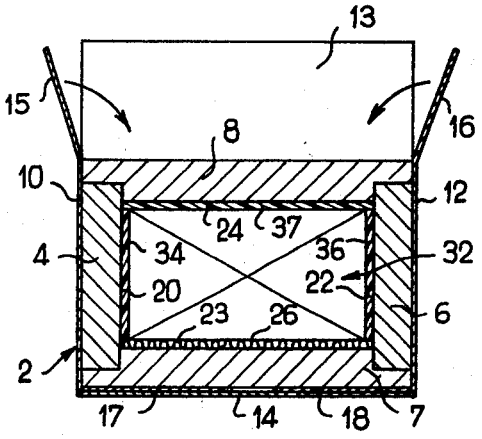
Figure 7:
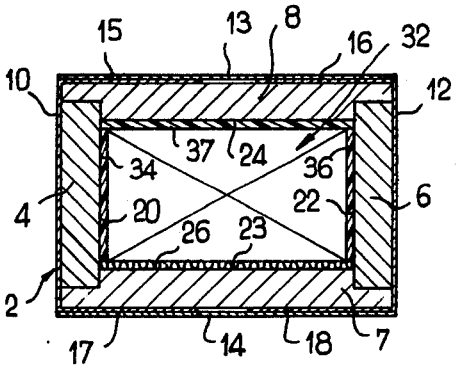

As simplified in FIGS. 5 and 6, the element 37 is then covered by the element 8 which closes the upper part of the enclosure 1 by fitting on the respective upper edges of the insulating elements 3 to 6 and its surface 24 comes into contact with the accumulating element 37 at the level 24*a*, the envelope 2 is then closed by turning down and superpositioning in the horizontal the flaps such as 15, 13 and 16 which are then joined together, which puts the assembly in the condition illustrated in FIG. 7, where the enclosure 1 around the product 32 is covered internally with accumulating elements such as 34 to 37, over all the periphery thereof with the exception of its base corresponding to the surface 23 of the insulating element 7, at the level of which it is still only lined by the reserve element 26.

Figure 8:
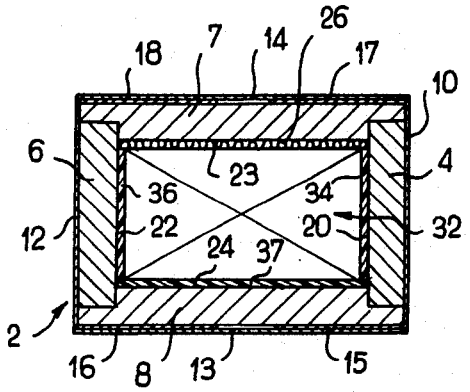

The following stage of conditioning comprises turning the box over, which movement positions the flaps such as 14, 17 and 18 in an upper horizontal position, as are the reserve element 26 and the insulating element 7, as shown in FIG. 8.

Figure 9:
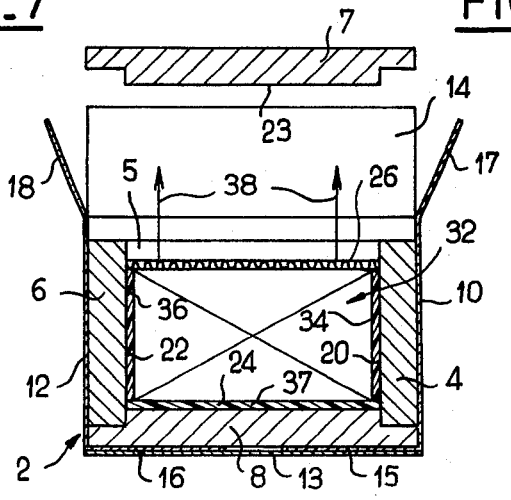

The envelope is then opened by pivoting the flaps such as 14, 17 and 18, which frees the insulating element 7 which is then removed to open the enclosure and to free the reserve element 26 which is removed, as indicated by the arrows 38 of FIG. 9.

Figure 10:
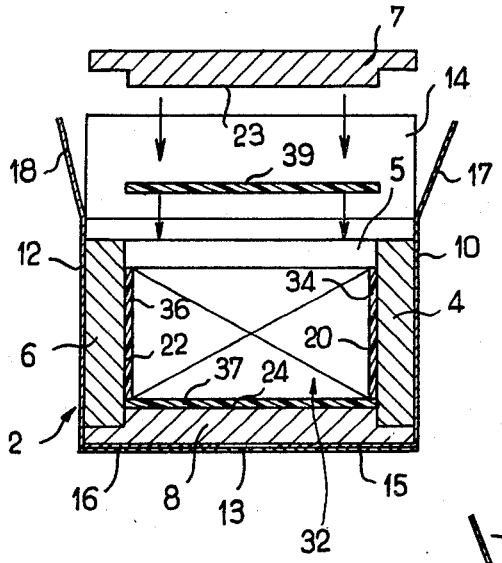

As illustrated by FIG. 10, the reserve element 26 is then replaced by an accumulating element 39 previously brought to a required predetermined temperature and which, due to its shape and dimensions which are identical to those of the element 26, is superpositioned by its edges on the corresponding edges of the accumulating elements, such as 34 to 36, lining the respective surfaces 19 to 22 of the insulating elements 3 to 6.

Figure 11:
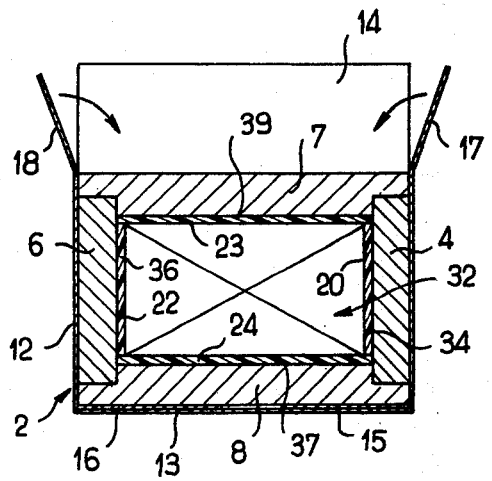

The insulating element 7 is then repositioned and is superpositioned on the element 39 and on the edges of the insulating elements 3 to 6 which are then turned upwards, as shown in FIG. 11, the envelope 2 is then re-closed by turning down the flaps such as 14, 17 and 18 into a horizontal position at 90° with respect to the walls 9 to 12, a position in which these flaps are joined.

Figure 12:
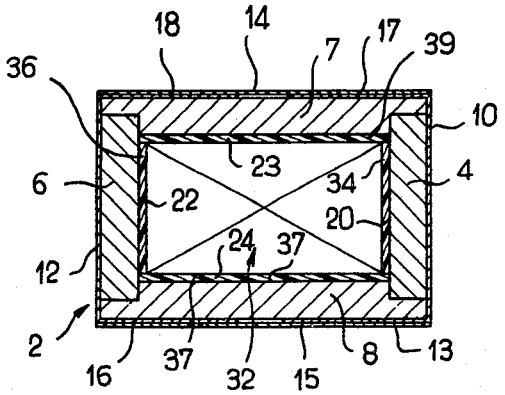

The structure which is then presented by the packing is illustrated in FIG. 12, where it may be seen that the product 32 is integrally enveloped by a double barrier outwardly composed of thermal insulating elements, of which only the elements 4, 6, 7 and 8 may be seen in FIG. 12, and inwardly by the accumulating elements which have previously been brought to the required, predetermined temperature, and of which only the elements 34, 36, 37 and 39 may be seen in FIG. 12. It will be noted that these two barriers are continuous and that the barrier composed of the accumulating elements brought to the required temperature is positioned as late as possible during the conditioning process, which allows the conditioned product 32 to be positioned under optimum preservation conditions at the required, predetermined temperature.

Of course, numerous variations of the embodiment which has been described and illustrated may be provided, notably with respect to the closing method of the envelope 2 which, in one embodiment, using, for example, two complementary insulating shells instead of the plurality of insulating panels 3 to 8 which are illustrated, could be omitted.

Of course, depending on the selected method of producing the box and on the selected mode of implementing the conditioning method, the reserve elements and the heat or cold accumulating elements which take the place of the reserve elements could be provided with a shape and a structure which is different from that which has been described and illustrated.

We claim:

1. A method of conditioning products which must be stored under determined temperature conditions, generally different from the conditions of the environment, utilizing a thermally insulated conditioning enclosure openable in any of a plurality of zones and initially opened in a determined zone comprising the steps of:

positioning removable reserve elements within the enclosures so as to integrally cover the inside periphery of the enclosure and delimit a volume open at the determined zone;

positioning the products within the delimited volume;

removing one or more of the reserve elements;

replacing removed reserve elements with accumulating elements brought to a required predetermined temperature and having shapes and dimensions similar to the removed reserve elements whereby said volume remains delimited by the accumulating elements and remaining reserve elements;

positioning within the enclosure at the level of the determined zone accumulating elements brought to the predetermined temperature and having shapes and dimensions so as to contact accumulating elements delimiting the volume;

closing the enclosure at the determined zone;

opening the enclosure at a different zone opposite the reserve elements remaining in the enclosure;

removing the reserve elements remaining in the enclosure;

replacing the removed reserve elements with accumulating elements brought to said predetermined temperature and having sizes and shapes whereby the accumulating elements within the enclosure are in mutual contact and form an integral barrier surrounding the products; and closing the enclosure at said different zone.

2. A method of conditioning products which must be stored under determined temperature conditions, generally different from the conditions of the environment, utilizing a conditioning enclosure having a thermally insulated base wall, a thermally insulated lateral periphery wall and a thermally insulated lid wall, the base wall and lid wall being movable with respect to the lateral periphery wall so as to expose the interior of the enclosure and the lid wall being initially positioned to define an initial open zone of the enclosure comprising the steps of:

integrally covering the surfaces of the lateral periphery wall and base wall inside the enclosure with removable reserve elements;

placing the products within a volume delimited by the reserve elements;

removing the reserve elements covering the surface of the lateral periphery wall;

replacing the removed reserve elements with accumulating elements brought to a predetermined temperature and having shapes and dimensions similar to those of the removed reserve elements whereby the accumulating elements and remaining reserve elements delimit said volume;

covering the delimited volume and contained products with accumulating elements brought to the required predetermined temperature and having shapes and dimensions so as to peripherally contact said accumulating elements delimiting the volume;

positioning the lid wall against the lateral periphery wall whereby the initial open zone is closed;

opening the enclosure at the level of the base wall;

removing all reserve elements previously covering the surface of the base wall;

replacing the removed reserve elements with accumulating elements brought to the required predetermined temperature and having shapes and dimensions similar to those of the reserved elements previously covering the base wall surface whereby the accumulating elements within the enclosure are in mutual peripheral contact and define a continuous barrier surrounding the products; and positioning the base wall against the lateral periphery wall whereby the enclosure is closed.

3. A system for conditioning products which must be stored under determined temperature conditions, generally different from the conditions of the environment, comprising:

a plurality of joining, thermally insulated walls defining an enclosure having a base, a lid, and a lateral periphery wall in peripheral contact with the base and the lid, the insulated walls forming the base and the lid being movable with respect to the lateral periphery wall so as to allow access to the interior of the enclosure;

a plurality of removable reserve elements positioned within the enclosure to define a continuous lining along the lateral periphery wall and the base; and a plurality of accumulating elements having shapes and dimensions similar to the removable reserve elements whereby the reserve elements may be removed and replaced by the accumulating elements to maintain said continuous lining.

* * * * *